US010708694B2

(12) United States Patent
Ilkorur et al.

(10) Patent No.: US 10,708,694 B2
(45) Date of Patent: Jul. 7, 2020

(54) CONTINUOUS SURROUND

(71) Applicant: Apple Inc., Cupertino, CA (US)

(72) Inventors: Onur I. Ilkorur, Campbell, CA (US); Alexander V. Salvatti, Morgan Hill, CA (US); Bonnie W. Tom, San Leandro, CA (US); Oliver Leonhardt, San Jose, CA (US); Christopher Wilk, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/835,365

(22) Filed: Dec. 7, 2017

(65) Prior Publication Data

US 2019/0082262 A1 Mar. 14, 2019

Related U.S. Application Data

(60) Provisional application No. 62/557,076, filed on Sep. 11, 2017.

(51) Int. Cl.

| | |
|---|---|
| ***H04R 7/18*** | (2006.01) |
| ***H04R 9/02*** | (2006.01) |
| ***H04R 9/06*** | (2006.01) |
| ***H04R 7/16*** | (2006.01) |

(52) U.S. Cl.

CPC ..... *H04R 7/18* (2013.01); *H04R 7/16* (2013.01); *H04R 9/025* (2013.01); *H04R 9/06* (2013.01); *H04R 2231/003* (2013.01); *H04R 2307/207* (2013.01)

(58) Field of Classification Search

CPC ... H04R 7/06; H04R 7/18; H04R 7/20; H04R 9/043; H04R 9/045; H04R 9/06; H04R 2231/003; H04R 2499/11; H04R 2499/15; H04R 7/16; H04R 2307/207

USPC ..... 381/396, 398, 403, 404, 423, 424, 431; 181/171, 172

See application file for complete search history.

(56) References Cited

U.S. PATENT DOCUMENTS

| | | | |
|---|---|---|---|
| 3,130,811 | A | 4/1964 | Petrie |
| 4,056,697 | A | 11/1977 | Heil |
| 4,324,312 | A | 4/1982 | Durbin |

(Continued)

FOREIGN PATENT DOCUMENTS

| | | | |
|---|---|---|---|
| CN | 102761810 | A | 10/2012 |
| CN | 103237284 | A | 8/2013 |

(Continued)

OTHER PUBLICATIONS

Utility Model Patent Evaluation Report for related Chinese Patent Appln No. ZL2018201047136 issued from the Chinese Patent Office dated Nov. 2, 2018; 5 pages.

*Primary Examiner* — Huyen D Le

(74) *Attorney, Agent, or Firm* — Womble Bond Dickinson (US) LLP

(57) ABSTRACT

A transducer assembly including a frame, a diaphragm positioned within the frame, a surround connecting the diaphragm to the frame, the surround having a corner section and a plurality of corrugations formed within the corner section, wherein each corrugation of the plurality of corrugations comprises a length dimension perpendicular to a line of maximum stress intersecting a radial axis of the corner section, a voice coil extending from one side of the diaphragm and a magnet assembly having a magnetic gap aligned with the voice coil.

18 Claims, 7 Drawing Sheets

(56) References Cited

U.S. PATENT DOCUMENTS

| | | | | |
|---|---|---|---|---|
| 4,433,214 | A | 2/1984 | Jasinksi | |
| 5,455,396 | A | 10/1995 | Willard et al. | |
| 6,095,280 | A | 8/2000 | Proni | |
| 6,176,345 | B1 | 1/2001 | Perkins et al. | |
| 6,516,077 | B1 | 2/2003 | Yamaguchi et al. | |
| 7,233,681 | B2 | 6/2007 | Tunmire et al. | |
| 7,275,620 | B1 | 10/2007 | Diedrich et al. | |
| 7,397,927 | B2 * | 7/2008 | Pircaro | H04R 7/20 181/172 |
| 7,729,504 | B2 | 6/2010 | Tsuda et al. | |
| 8,139,812 | B2 | 3/2012 | Basnet et al. | |
| 8,170,268 | B2 | 5/2012 | Weyreuther | |
| 8,208,678 | B2 | 6/2012 | Mundorf | |
| 8,311,263 | B2 | 11/2012 | Huang | |
| 8,397,861 | B1 | 3/2013 | Xu et al. | |
| 8,442,259 | B2 | 5/2013 | Williamson | |
| 8,682,021 | B2 * | 3/2014 | Kosuda | H04R 7/06 381/398 |
| 8,885,868 | B2 | 11/2014 | Davidson et al. | |
| 8,903,117 | B1 | 12/2014 | Dai et al. | |
| 8,995,704 | B2 * | 3/2015 | Huang | H04R 9/043 181/171 |
| 10,129,652 | B2 | 11/2018 | Vieites et al. | |
| 2002/0170773 | A1 | 11/2002 | Stead et al. | |
| 2003/0068064 | A1 | 4/2003 | Czerwinski | |
| 2003/0121718 | A1 | 7/2003 | Stead et al. | |
| 2004/0086143 | A1 | 5/2004 | Espiritu | |
| 2006/0096803 | A1 | 5/2006 | White et al. | |
| 2006/0251286 | A1 | 11/2006 | Stiles | |
| 2009/0169049 | A1 | 7/2009 | Sun | |
| 2009/0208048 | A1 | 8/2009 | Haas | |
| 2011/0164782 | A1 | 7/2011 | Bogdanov et al. | |
| 2012/0039494 | A1 | 2/2012 | Ellis | |
| 2012/0170778 | A1 * | 7/2012 | Wei | H04R 9/06 381/191 |
| 2013/0279735 | A1 | 10/2013 | Chu | |
| 2016/0080870 | A1 | 3/2016 | Vieites et al. | |
| 2017/0111729 | A1 | 4/2017 | Robineau et al. | |
| 2017/0245057 | A1 | 8/2017 | Graziab et al. | |
| 2018/0035213 | A1 | 2/2018 | Shan et al. | |

FOREIGN PATENT DOCUMENTS

| | | | |
|---|---|---|---|
| CN | 204518056 | U | 7/2015 |
| CN | 204518057 | U | 7/2015 |
| CN | 104902393 | A | 9/2015 |
| CN | 204616087 | U | 9/2015 |
| EP | 0556786 | A2 | 8/1993 |
| EP | 0556786 | A3 | 10/1993 |
| EP | 0556786 | B1 | 7/2002 |
| EP | 0912072 | B1 | 7/2005 |
| EP | 1788839 | A1 | 5/2007 |
| GB | 2499228 | A | 8/2013 |
| JP | S58127499 | U | 8/1983 |

* cited by examiner

CONTINUOUS SURROUND

CROSS-REFERENCE TO RELATED APPLICATION

This application claims the benefit of the earlier filing date of U.S. Provisional Patent Application No. 62/557,076, filed Sep. 11, 2017 and incorporated herein by reference.

FIELD

An embodiment of the invention is directed to a transducer surround with improved performance, more specifically a surround having continuous corner corrugations with a particular orientation to achieve improved linear stiffness and reduced fatigue. Other embodiments are also described and claimed.

BACKGROUND

Whether listening to an MP3 player while traveling, or to a high-fidelity stereo system at home, consumers are increasingly choosing intra-canal and intra-concha earphones for their listening pleasure. Both types of electroacoustic transducer devices have a relatively low profile housing that contains a receiver or driver (an earpiece speaker). The low profile housing provides convenience for the wearer, while also providing very good sound quality.

These devices, however, do not have sufficient space to house high fidelity speakers. This is also true for portable personal computers such as laptop, notebook, and tablet computers, and, to a lesser extent, desktop personal computers with built-in speakers. Such devices typically require speaker enclosures or boxes that have a relatively low rise (e.g., height as defined along the z-axis) and small back volume, as compared to, for instance, stand alone high fidelity speakers and dedicated digital music systems for handheld media players. Many of these devices use what are commonly referred to as "micro-speakers." Micro-speakers are a miniaturized version of a loudspeaker, which use a moving coil motor to drive sound output. The moving coil motor may include a low profile diaphragm (or sound radiating surface) assembly, including a sound radiating surface and a suspension (or surround), a voice coil suspended from the sound radiating surface and a magnet assembly positioned within an enclosure. The input of an electrical audio signal to the moving coil causes the sound radiating surface to vibrate axially thereby creating pressure waves outside the driver enclosure. The suspension surrounds and suspends the sound radiating surface within the enclosure and allows it to vibrate axially.

SUMMARY

An embodiment of the invention is a surround for suspending a diaphragm within a transducer which has a geometry that results in improved acoustic performance of the transducer. More specifically, the surround geometry results in improved linear stiffness with less likelihood of fatigue over time due to stress created by the pistonic (or z-axis) motion of the diaphragm. Representatively, in the case of a single suspension transducer, a surround performs many functionalities such as positioning the voice coil within the air gap of the magnet assembly, sealing the diaphragm to the enclosure to acoustically isolate the front side from the back side, contributing to the stiffness and influencing the resonance frequency of the transducer. Thus, during operation, it is important that the surround deform in a controlled way to, for example, prevent the voice coil from hitting rigid components within the transducer and to maintain the most linear stiffness possible within the displacement extremes of the diaphragm. The material stiffness and the stiffness defined by the surround geometry contribute to the stresses occurring within the material, and therefore play an important role in both fatigue and stiffness linearity. In the case of a micro-speaker, the surround may be rectangular to increase the radiating surface. Due to this rectangular shape, however, different sections of the surround have different deformation characteristics as the surround moves away from the rest position (e.g. due to diaphragm vibrations), which in turn, subjects certain areas of the surround to more stress than others. For example, the most complicated deformation occurs at the corners of the surround. In the corners, as the voice coil moves out of the air gap (coil-out direction), the highest point of the surround (in the case of a surround having an arcuate shape) tries to increase in radius and move away from the center of the surround. As the voice coil moves into the air gap (coil-in direction) the highest point of the surround tries to reduce in radius and moves toward the center of the surround. These radial changes introduce circumferential stresses over the surround geometry, and may lead to non linear behavior and fatigue development over time. The present invention reduces this non linear behavior and fatigue over time by introducing an improved corner geometry in which a number of continuous corrugations are formed in each corner of the surround and in a particular orientation with respect to a maximum stress line across each corner.

Representatively, in one embodiment, the invention is directed to a transducer having an enclosure separating a surrounding environment from an encased space, a diaphragm positioned within the encased space, a surround connecting the diaphragm to the enclosure, a voice coil extending from one side of the diaphragm and a magnet assembly having a magnetic gap (or air gap) aligned with the voice coil. In one embodiment, the transducer is an electroacoustic transducer such as a loudspeaker, more specifically, a micro-speaker. The term "micro-speaker" as used herein is intended to refer to a speaker having a size range (e.g., a diameter or longest dimension) of from about 10 mm to 75 mm, in some cases, within a size range of from 10 mm to 20 mm. Returning now to the surround, the surround may have a corner section and a plurality of corrugations formed within the corner section. Each corrugation of the plurality of corrugations may have a length dimension perpendicular to a line of maximum stress across the corner section.

More specifically, in one embodiment, the invention is directed to a transducer assembly including a frame, a diaphragm positioned within the frame, a surround connecting the diaphragm to the frame, a voice coil extending from one side of the diaphragm, and a magnet assembly having a magnetic gap aligned with the voice coil. The surround may include a corner section and a plurality of corrugations formed within the corner section. Each corrugation of the plurality of corrugations may have a length dimension perpendicular to a line of maximum stress intersecting a radial axis of the corner section. In some cases, the transducer is a micro-speaker, and the line of maximum stress is parallel to a line tangential to an interior arcuate edge of the corner section. In addition, in some embodiments, the line of maximum stress may be perpendicular to the radial axis. In addition, the line of maximum stress may be a region across the corner determined to be subject to a maximum level of deformation stress based on a finite element analysis of the surround corner. Still further, the length dimension of each corrugation may be parallel to the radial axis. The radial axis may be an axis that bisects the corner section, and the line of maximum stress intersects the radial axis at a point that is between an inner edge and an outer edge of the corner section. In some cases, the plurality of corrugations may include a continuous second derivative and all other derivatives are continuous. Each corrugation may extend from an inner edge to an outer edge of the corner section. The surround may be a single, substantially solid membrane.

In other embodiments, the invention is directed to a surround for suspending a transducer diaphragm. The surround may include a first membrane section having a length dimension parallel to a first axis, a second membrane section having a length dimension parallel to a second axis, a corner membrane section at an intersection between the first axis of the first membrane section and the second axis of the second membrane section, wherein the first axis and the second axis intersect to form a ninety degree angle and the corner membrane section comprises an arcuate inner edge, and a number of continuous corrugations within the corner membrane section. Each corrugation may have a length dimension perpendicular to a line tangential to the arcuate inner edge of the corner membrane section. In addition, the continuous corrugations may include a series of uninterrupted ribs and furrows. In addition, in some embodiments, the corrugations may have a curved cross-sectional shape. In addition, the length dimension of the corrugations may be perpendicular to a line of maximum stress that is parallel to the line tangential to the arcuate inner edge and intersects a center of the corner membrane section. Still further, the length dimensions of each corrugation may be parallel to one another, and in some cases, may run from an inner edge to an outer edge of the corner membrane section.

In still further embodiments, the invention is directed to a micro-speaker surround having a membrane for connecting a diaphragm to an enclosure, the membrane having a first pair of parallel side sections, a second pair of parallel side sections, and a set of corner sections connecting the first pair of parallel side sections and the second pair of parallel side sections; and a plurality of continuous corrugations within each of the corner sections of the set of corner sections, and wherein each of the corrugations of the plurality of continuous corrugations within each of the corner sections have a length dimension perpendicular to a line of maximum stress intersecting a radial axis of their respective corner section. In some cases, the first set of parallel sides may be longer than the second set of parallel sides. Still further, the line of maximum stress may intersect the radial axis at an angle of ninety degrees. In addition, the plurality of corrugations within adjacent corner sections may be spaced a distance apart such that they do not overlap. Still further, the plurality of corrugations within each of the corner sections may be parallel to the radial axis of their respective corner section.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
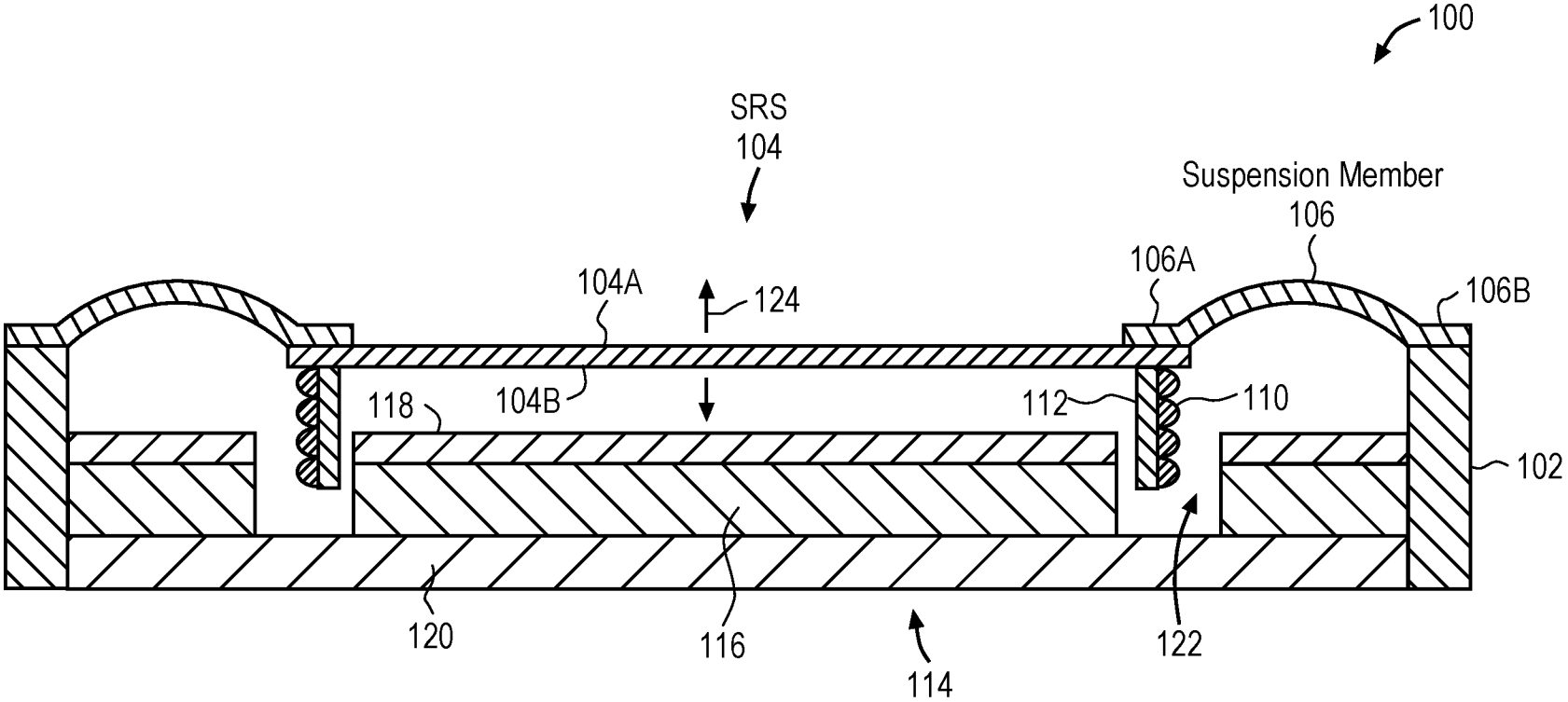
FIG. 1 illustrates a cross-sectional side view of one embodiment of a transducer assembly.

FIG. 1 illustrates a cross sectional side view of one embodiment of a transducer. Transducer 100 may be any type of transducer for example, an electroacoustic transducer that uses a pressure sensitive diaphragm and circuitry to produce a sound in response to an electrical audio signal input. Representatively, transducer 100 may, for example, be a micro-speaker driver having a size range (e.g., a diameter or longest dimension) of from about 10 mm to 75 mm, in some cases, within a size range of from 10 mm to 20 mm. The electrical audio signal may be a music signal input to driver 100 by a sound source. The sound source may be any type of audio device capable of outputting an audio signal, for example, an audio electronic device such as a portable music player, home stereo system or home theater system capable of outputting an audio signal.

Transducer 100 may include a frame 102, which may be part of a transducer enclosure or box whose height (or rise) and speaker back volume (also referred to as an acoustic chamber) are considered to be relatively small. For example, the enclosure height or rise may be in the range of about 1 millimeter (mm) to about 10 mm. The concepts described here, however, need not be limited to transducer enclosures whose rises are within these ranges. Each of the components of transducer 100, for example components of a speaker assembly as will be discussed herein, may be positioned within, or otherwise connected to, frame 102.

In one embodiment, one of the components of transducer 100 (e.g., speaker assembly components) positioned within frame 102 may include a sound radiating surface (SRS) 104. The SRS 104 may also be referred to herein as an acoustic radiator, a sound radiator or a diaphragm. SRS 104 may be any type of flexible membrane capable of vibrating in response to an acoustic signal to produce acoustic or sound waves. For example, SRS 104 may include a top face 104A, which generates sound to be output to a user, and a bottom face 104B, which is acoustically isolated from the top face 104A, so that any acoustic or sound waves generated by the bottom face 104B do not interfere with those from the top face 104A. The top face 104A may be considered the "top" face because it faces, or includes a surface substantially parallel to, a top side of frame 102 (not shown). Similarly, the bottom face 104B may be considered a "bottom" face because it faces, or includes a surface substantially parallel to, a bottom surface of frame 102. Although shown substantially planar, in some embodiments, SRS 104 may have an out-of-plane region for geometric stiffening. SRS 104 may, for example, be made of a single layer of material, or multiple layers of material for increased stiffness. For example, SRS 104 made of a polyester material such as polyethylene naphthalate (PEN) or, one or more layers of a PEN thermofoil.

SRS 104 may be suspended within frame 102 by a suspension member 106, also referred to herein as a suspension or surround. Suspension member 106 allows for a substantially vertical or pistonic movement of SRS 104, that is in a substantially up and down direction as illustrated by arrow 124, relative to fixed frame 102. In one embodiment, suspension member 106 may have an inner edge 106A connected to an outer edge of SRS 104 (e.g. by an adhesive or molded) and an outer edge 106B attached to frame 102 to suspend SRS 104 within frame 102. Suspension member 106 may be one continuous membrane which surrounds the SRS 104. For example, in one embodiment, SRS 104 may have a rectangular or square shaped profile. Suspension member 106, in turn, may be a similarly shaped square or rectangular membrane, but with an open center to accommodate SRS 104 such that it surrounds SRS 104. In addition, suspension member 106 may have a corner geometry to improve non linearity by improving linear stiffness, as well as reduce fatigue, as will be discussed in more detail in reference to FIG. 2 to FIG. 7. In addition, in some embodiments, suspension member 106 may have what is considered a "rolled" or "arcuate" configuration in that it has a curved region between the inner edge 106A and outer edge 106B. This curved configuration may allow for greater compliance in the z-direction (e.g., a direction perpendicular to the suspension member plane), and in turn, facilitates an up and down movement, also referred to as a vibration, of the SRS 104. It should be understood, however, that in some embodiments, suspension member 106 could be flat, or entirely planar.

In some embodiments, suspension member 106 may further provide a seal between SRS 104 and frame 102. This seal may prevent acoustic cancellation and water ingress beyond (e.g., below) SRS 104 and therefore prevents any water, which may unintentionally enter transducer 100, from damaging the various electronic components and circuitry associated with transducer 100 (e.g., a voice coil). For example, suspension member 106 may be a membrane made of any compliant material that is sufficiently flexible to allow movement of SRS 104 in order to produce acoustic or sound waves. Representatively, suspension member 106 may be made of a polyester material such as polyethylene naphthalate (PEN), or a silicone. The term "membrane" as used herein is intended to refer to a relatively thin, pliable, sheet of material that can occupy an entire space between SRS 104 and frame 102, and provide an acoustic and/or water tight seal.

Transducer 100 may further include a voice coil 110 positioned along a bottom face 104B of SRS 104 (e.g., a face of SRS 104 facing magnet assembly 114). For example, in one embodiment, voice coil 110 may include a pre-wound coil assembly (which includes the wire coil held in its intended position by a lacquer or other adhesive material), which is wrapped around a bobbin or former 112. The end of the former 112 may be directly attached to the bottom face 104B of SRS 104, such as by chemical bonding or the like. In another embodiment, former 112 may be omitted, and voice coil 110 may be directly attached to the bottom face 104B of SRS 104. In still further embodiments, the former 112 or voice coil 110 may instead be attached directly to the bottom face of suspension member 106. In one embodiment, voice coil 110 may have a similar profile and shape to that of SRS 104. For example, where SRS 104 has a square or rectangular shape, voice coil 110 may also have a similar shape. For example, voice coil 110 may have a substantially rectangular or square shape. Although not shown, voice coil 110 may further have electrical connections to a pair of terminals through which an input audio signal is received, in response to which voice coil 110 produces a changing magnetic field that interacts with the magnetic field produced by magnet assembly 114 for providing a driving mechanism for transducer 100.

Magnet assembly 114 may be positioned along a bottom side of frame 102 or otherwise below SRS 104. Magnet assembly 114 may include a magnet 116 (e.g., a NdFeB magnet), with a top plate 118 and a yoke 120 for guiding a magnetic circuit generated by magnet 116 across gap 122. A one-magnet embodiment is shown here, although multi-magnet motors are also contemplated.

Figure 2:
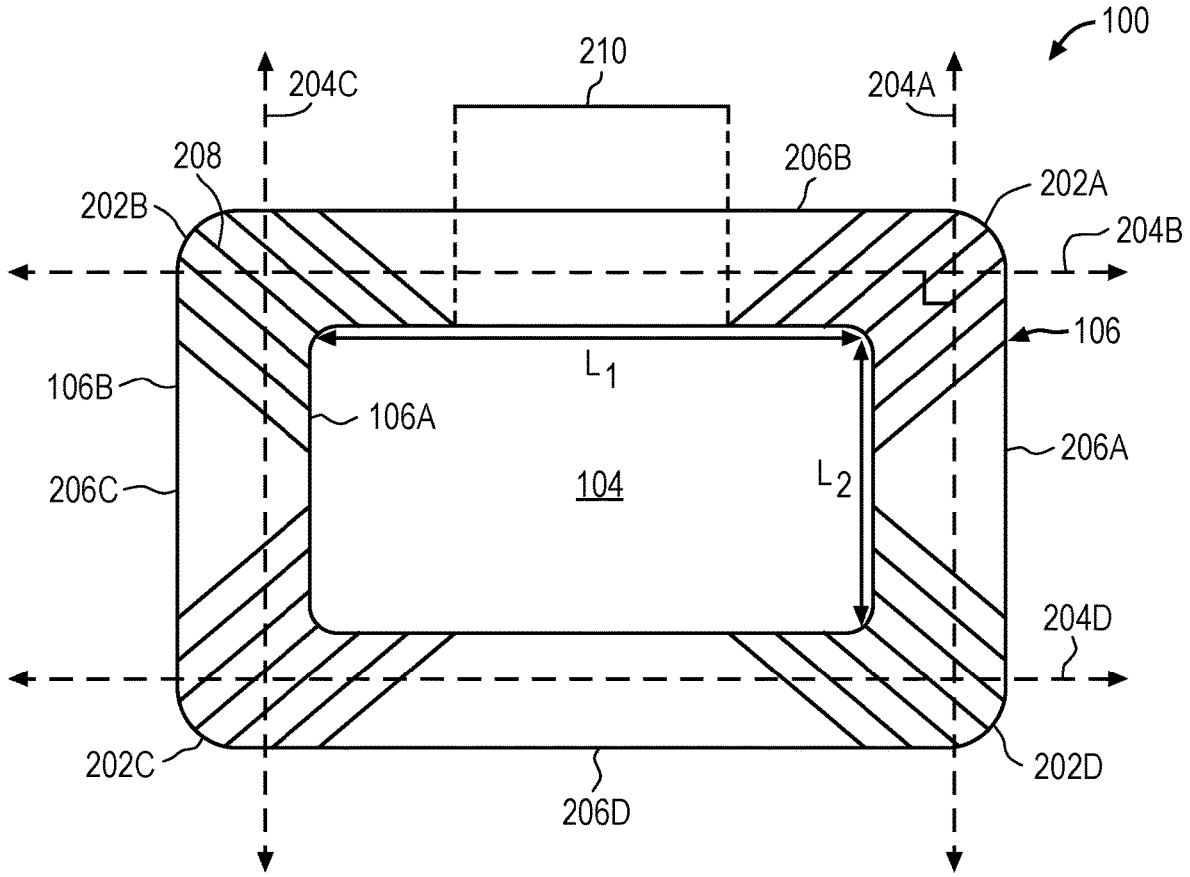
FIG. 2 illustrates a top plan view of one embodiment of a surround integrated within the transducer assembly of FIG. 1.

The specific features of suspension member 106 that allow for improved linear stiffness and fatigue will now be discussed in reference to FIG. 2 to FIG. 7. Representatively, FIG. 2 illustrates a top plan view of one embodiment of a suspension member of FIG. 1. From this view, it can be seen that suspension member 106 entirely surrounds SRS 104 and has a generally rectangular shaped profile. Representatively, suspension member 106 is made up of sections or sides 206A, 206B, 206C and 206D, which are connected, or otherwise joined, by corners 202A, 202B, 202C and 202D. Sides 206A and 206C may be substantially straight and parallel to each other. For example, sides 206A and 206C may each have a length dimension ($L_1$) which is parallel to lengthwise axes 204A and 204C as shown. In this aspect, sides 206A and 206C may be referred to herein as a set or pair of parallel sections or sides. Similarly, sides 206B and 206D may be substantially straight and parallel to each other. For example, sides 206B and 206D may have a length dimension ($L_2$) which is parallel to lengthwise axes 204B and 204D as shown. In this aspect, sides 206B and 206D may be referred to herein as a set or pair of parallel sections or sides. In addition, in the illustrated embodiment, sides 206B and 206D are longer than sides 206A and 206C such that suspension member 106 has a rectangular profile. In other embodiments, however, sides 206B and 206D may be shorter than sides 206A and 206C. In addition, in some embodiments, sides 206B and 206D may have a same length as sides 206A and 206C such that suspension member 106 has a square shaped profile.

Corners 202A-202D may be considered the regions or portions of suspension member 106 where each of sides 206A-206D intersect, or said another way, where each of axes 204A-204D intersect. In some embodiments, axes 204A and 204C may be perpendicular to axes 204B and 204D such that a right or ninety degree angle is formed at their point of intersection, as shown. As previously discussed, due to these ninety degree angles, corners 202A-202D can be subjected to particularly complicated deformation characteristics as SRS 104 vibrates, which in turn leads to increased stress at these regions. These complicated deformation characteristics will now be discussed in reference to FIG. 3 and FIG. 4.

Figure 3:
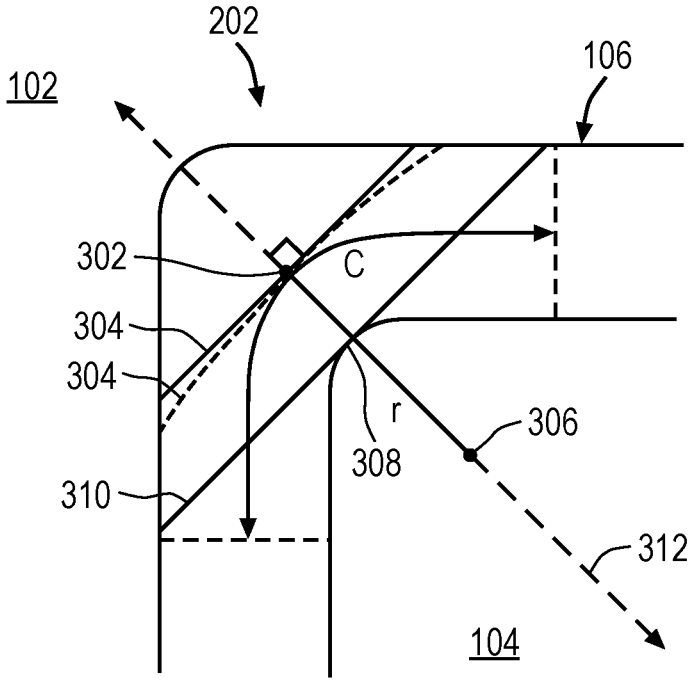
FIG. 3 illustrates a magnified top view of one embodiment of a corner of a surround.
Figure 4:
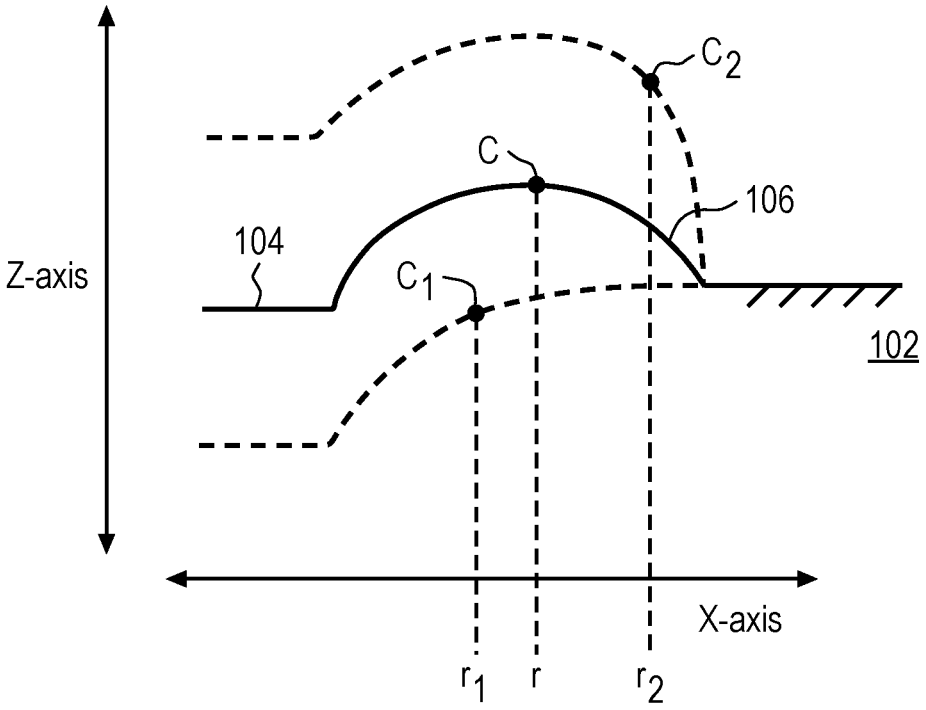
FIG. 4 illustrates a schematic diagram of the deformation characteristics of the surround of FIG. 3.

Representatively, FIG. 3 is a magnified view of a representative corner 202, and FIG. 4 is a schematic illustration of the corner deformations described in reference to FIG. 3. In particular, the magnified corner view of FIG. 3, illustrates a curved surround corner 202 having what is considered the highest and/or center point 302, and the corresponding circumference (c) and a radius (r) with respect to point 302. During operation, as surround corner 202 moves up and down along a z-axis (e.g. z-axis as shown in FIG. 4), the highest and/or center point 302 of corner 202 experiences tension in a radial direction along radius (r), and wants to move toward or away from the center of the radius illustrated by point 306 (e.g., along the x-axis as shown in FIG. 4), and along the circumference (c).

More specifically, as shown in FIG. 4, in the resting position, suspension member 106 has a radius (r) and circumference (c), where the illustrated circumference point (c) corresponds to the highest point 302 illustrated in FIG. 3. When suspension member 106 moves in a downward direction along the z-axis as SRS 104 and voice coil 110 are moving toward magnet assembly 114 (also referred to as a coil-in direction), suspension member 106 wants to reduce in radius ($r_1$) (e.g., point 302 moves toward the center point 306 in FIG. 3) and circumference ($c_1$). In addition, when suspension member 106 moves in an upward direction along the z-axis as SRS 104 and voice coil 110 are moving away from the magnet assembly 114 (also referred to as a coil-out direction), the suspension member 106 wants to increase in radius ($r_2$) (e.g., point 302 moves away from the center point 306) and circumference ($c_2$). As can be seen from the schematic illustration of FIG. 4, the change in radius between the resting radius (r) and the downward radius ($r_1$) (e.g., coil-in position) is less than the change in radius between the resting radius (r) and the upward radius ($r_2$) (e.g., coil-out position).

These radial and/or circumferential changes introduce stresses over the surround geometry, particularly in the circumferential direction, with the most stress being found along a maximum stress path across the corner. The maximum stress path or line can be calculated using a standard finite element analysis based on the selected material (having a particular elasticity), size of the corner and maximum deflection or excursion. It should further be understood that the maximum stress path or line referred to herein is calculated during manufacturing of the surround, and is therefore calculated prior to forming the "arcuate" or "rolled" region shown in FIG. 1. In other words, it is calculated based on a flat micro-speaker surround surface. In the case of a micro-speaker, however, even after this "rolled" region is formed, the region of maximum stress may still be described as a relatively straight line across the corner, despite the additional curvature. It is contemplated, however, that in other embodiments, a slightly curved maximum stress line (as illustrated by the dashed line 304) could be used to illustrate this region of maximum stress. For example, where the surround has a "rolled" or "arcuate" region and is larger than a surround dimensioned for use in a micro-speaker (e.g., greater distance between the inner and outer corner edges), the maximum stress line may be slightly curved. It should be understood, however, that even where the dimensions are changed and the line of maximum stress is curved or otherwise deviates from a straight line as shown, the corrugations should still be perpendicular to the maximum stress line.

In this aspect, the actual location of the region of maximum stress illustrated by line 304 can be defined in various ways. For example, in the case of a micro-speaker, the maximum stress path or line 304 of the suspension member corner 202 can be defined as a line of stress that crosses the center point 302 of the corner, and is parallel to, and offset from, a line 310 that is tangential to the interior arcuate surface 308 of corner 202. The center point 302 can be defined, for example, as the region halfway between the inner and out edges of corner 202, along radius (r). In addition, since the maximum stress path or line 304 may be parallel to the tangential line 310 of corner 202 as shown, the maximum stress path or line 304 may also be referred to herein as a tangential line which is offset with respect to the corner interior arcuate surface 308. In addition, as can be seen from FIG. 3, the maximum stress path or line 304 may also be perpendicular to the diagonal or radial axis 312 of corner 202, and offset from the interior arcuate surface 308, and can therefore also be defined with respect to the radial axis 312. For example, the maximum stress path or line 304 may be defined as a line across corner 202 that intersects the radial axis 312, and in some cases bisects the radial axis 312 (or diagonal line), of corner 202 at an angle of ninety degrees.

These circumferential stresses along the maximum stress path or line 304 can be the main cause of non-linear behavior and fatigue development. To alleviate this stress, and in turn reduce non-linear behavior and fatigue development, a number of ribs or corrugations having a particular orientation with respect to this region of maximum stress are introduced into the suspension member corners. In particular, returning now to FIG. 2, each of corners 202A-202D include a number of ribs or corrugations 208. The ribs or corrugations 208 may extend in a lengthwise direction from an inner edge 106A to an outer edge 106B of each of corners 202A-202D. The ribs or corrugations 208 may be confined to their respective corners such that corrugations 208 in adjacent corners do not overlap. For example, corrugations 208 within their respective corners 202A-202D may be spaced apart by non-corrugated regions 210 within areas of sides 206A-206B between the corners 202A-202D. Each of corners 202A-202D may include any number of corrugations suitable for improving linear behavior and fatigue, as discussed herein.

Figure 5:
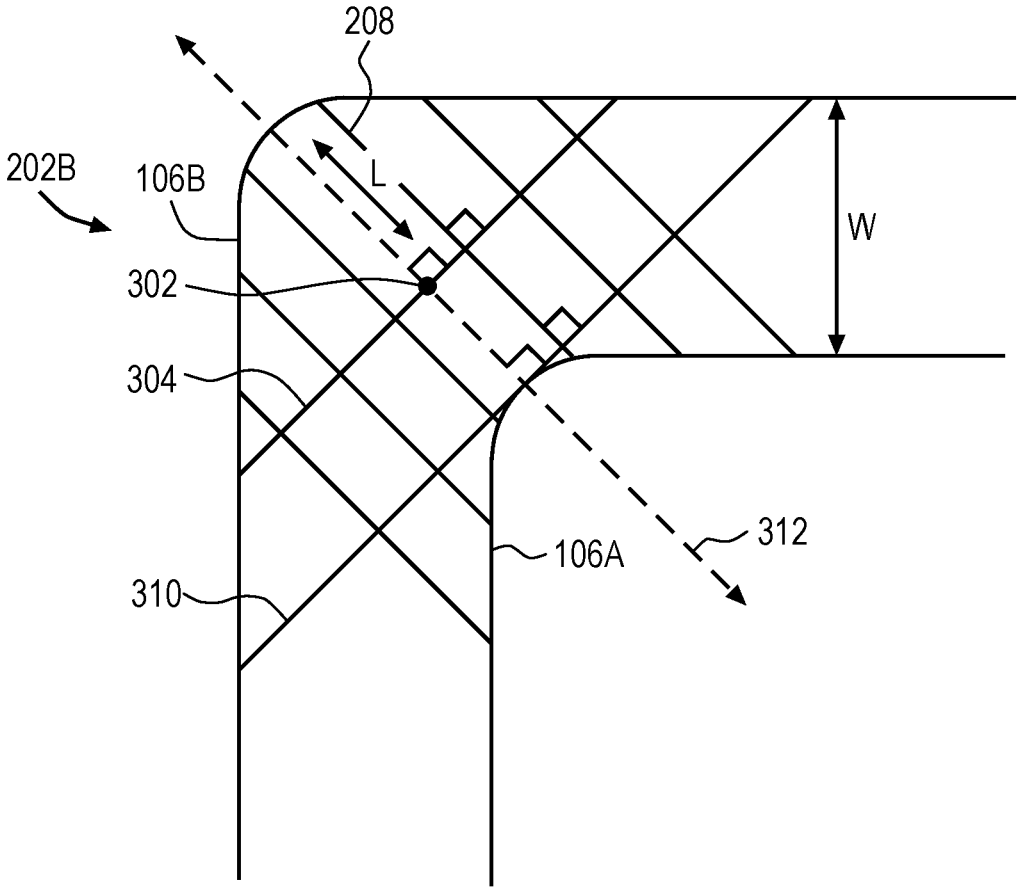
FIG. 5 illustrates a magnified top plan view of one embodiment of a corner of a surround integrated within the transducer assembly of FIG. 1.

The particular orientation and structure of the corrugations will now be discussed in reference to FIG. 5 to FIG. 8. FIG. 5 illustrates a magnified top plan view of corner 202B of FIG. 2. From this view, it can be seen that corner 202B includes a number of corrugations 208 that run across an entire width dimension (W) of corner 202B. In other words, from the inner edge 106A to the outer edge 106B of corner 202B. Each of corrugations 208 may have a same orientation with respect to the maximum stress path or line 304 (and the tangential line 310). For example, each of corrugations 208 may run in a direction perpendicular to the maximum stress path or line 304. More specifically, as can be seen from FIG. 5, each of corrugations 208 have a length axis or dimension (L) that intersects the maximum stress path or line 304 at a ninety degree angle. In addition, where the maximum stress path or line 304 is parallel to the tangential line 310 as previously discussed, the length axis or dimension (L) of corrugations 208 may also be defined as running in a direction perpendicular to, or being perpendicular to, tangential line 310, or intersecting the tangential line 310 at an angle of ninety degrees. In addition, maximum stress path or line 304 and tangential line 310 intersect the diagonal or radial axis 312 of corner 202. The diagonal or radial axis 312 may be considered the axis that extends in a diagonal or radial direction, and bisects corner 202 as shown in FIG. 5. The maximum stress path or line 304 and tangential line 310 may, in some embodiments, intersect radial axis 312 at an angle of ninety degrees. Thus, in some embodiments, the length dimension (L) of corrugations 208 may also be described as being perpendicular to a line (e.g., line 304 or line 310) intersecting the radial axis 312 of corner 202. In addition, in some embodiments, corrugations 208 may be substantially straight structures that are parallel to one another, and/or parallel to radial axis 312. In other words, corrugations 208 do not zig zag, bend, curve or otherwise have a tortious configuration along the length dimension (L). Still further, it should be noted that although the maximum stress path or line 304 is illustrated as a straight line, it could be slightly curved and corrugations 208 could be perpendicular to this slightly curved line.

Figure 6:
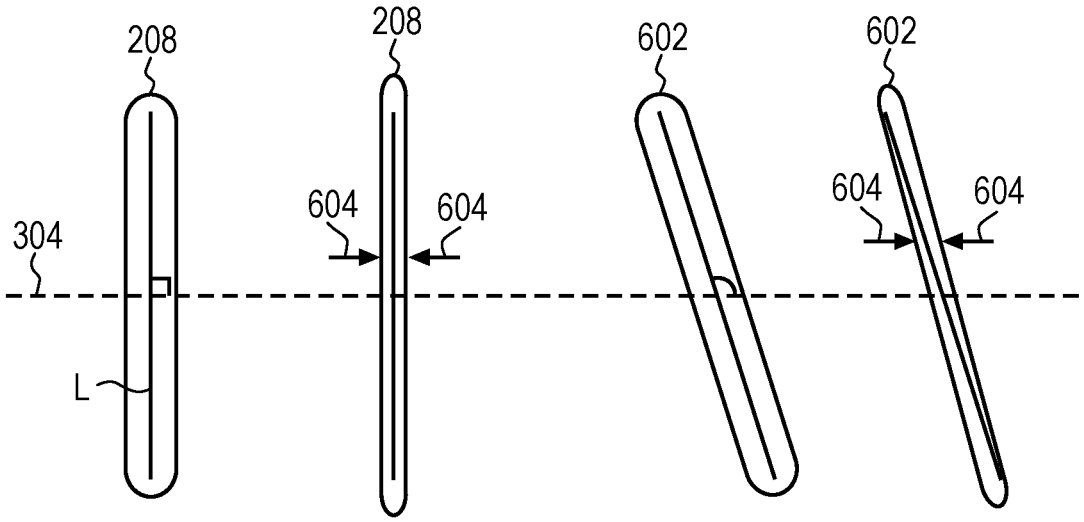
FIG. 6 illustrates one embodiment of a corrugation integrated within the surround of FIG. 2.

It has been found that when the corrugations 208 are oriented perpendicular to the maximum stress line 304 at each corner as described herein, as opposed to at another angle, the corrugations 208 absorb the circumferential and radial deformations during diaphragm excursion more evenly. This, in turn, helps to restore linearity and reduce surround fatigue over time. For example, FIG. 6 illustrates a magnified view of a corrugation 208 oriented perpendicular to the maximum stress line 304 and a corrugation 602 oriented at an angle other than ninety degrees (e.g., an obtuse or acute angle) with respect to the maximum stress line. As can be seen from FIG. 6, the perpendicularly oriented corrugation 208 absorbs the forces (illustrated by arrows 604) due to the radial and/or circumferential changes in the surround and deforms (e.g., contracts) relatively evenly along the length dimension (L). In contrast, in the case of the non-perpendicularly oriented corrugation 208, these forces 604 cause the corrugation 208 to deform (e.g., contract) unevenly along the length dimension, almost in a twisting like manner. This type of corrugation deformation, in comparison to a relatively even deformation, is not as effective at absorbing surround changes in radius and/or circumference, and in turn not as effective against fatigue.

Figure 7:
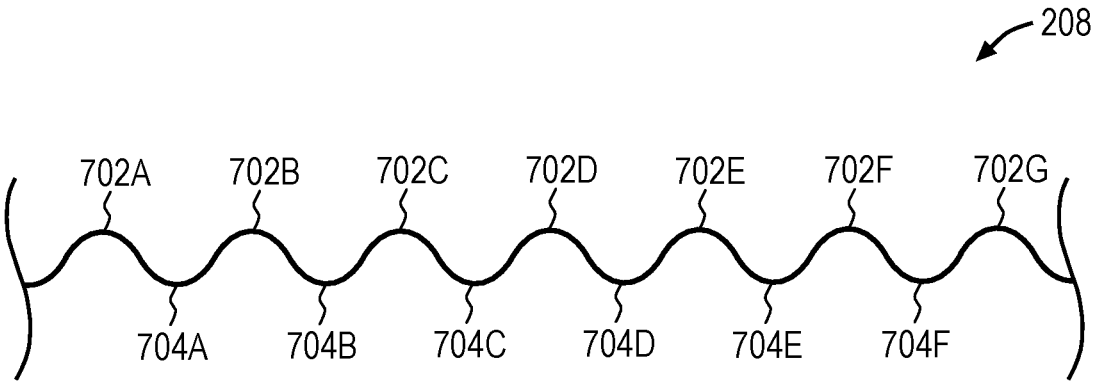
FIG. 7 illustrates a cross-sectional side view of a number of corrugations in the surround of FIG. 2.

In addition to the orientation of corrugations 208, it is further important in achieving a reduction in fatigue and improved linearity that corrugations 208 within each of their respective corners 202A-202D are continuous and smooth. To illustrate this aspect, FIG. 7 shows a magnified cross-sectional side view of a series of corrugations within a respective corner. Representatively, from this view, it can be seen that corrugations 208 are made up of a series of alternating ribs or ridges 702A, 702B, 702C, 702D, 702E, 702F, and 702G, and furrows 704A, 704B, 704C, 704D, 704E and 704F. Each of the alternating ridges 702A-702G and furrows 704A-704F may be referred to as a corrugation, and may be considered continuous in that they have an immediate connection or spatial relationship, with no spaces or gaps in between adjacent structures. For example, the geometry of corrugations 208 may be defined as having a continuous second derivative and all other derivatives are continuous. In this aspect, corrugations 208 are also considered smooth structures and do not have any abrupt bends or corners where one transitions to the next. Said another way, the peaks and valleys formed by the ridges 702A-702G and furrows 704A-704F are curved, or otherwise formed by continuously bending lines, and have a radius, as previously discussed. It should further be understood, that although seven ridges 702A-702G are illustrated, the surround corner may include any number of ridges, or corrugations. In addition, each surround corner may include the same number, or a different number of corrugations. In addition, it should be understood that although one particular surround corner, namely corner 202B has been described in detail, the description with respect to corner 202B applies to each of corners 202A, 202C, and 202D. Thus, all of corners 202A-202D will have corrugations 208 which are perpendicular to the maximum stress line and continuous.

Figure 8:
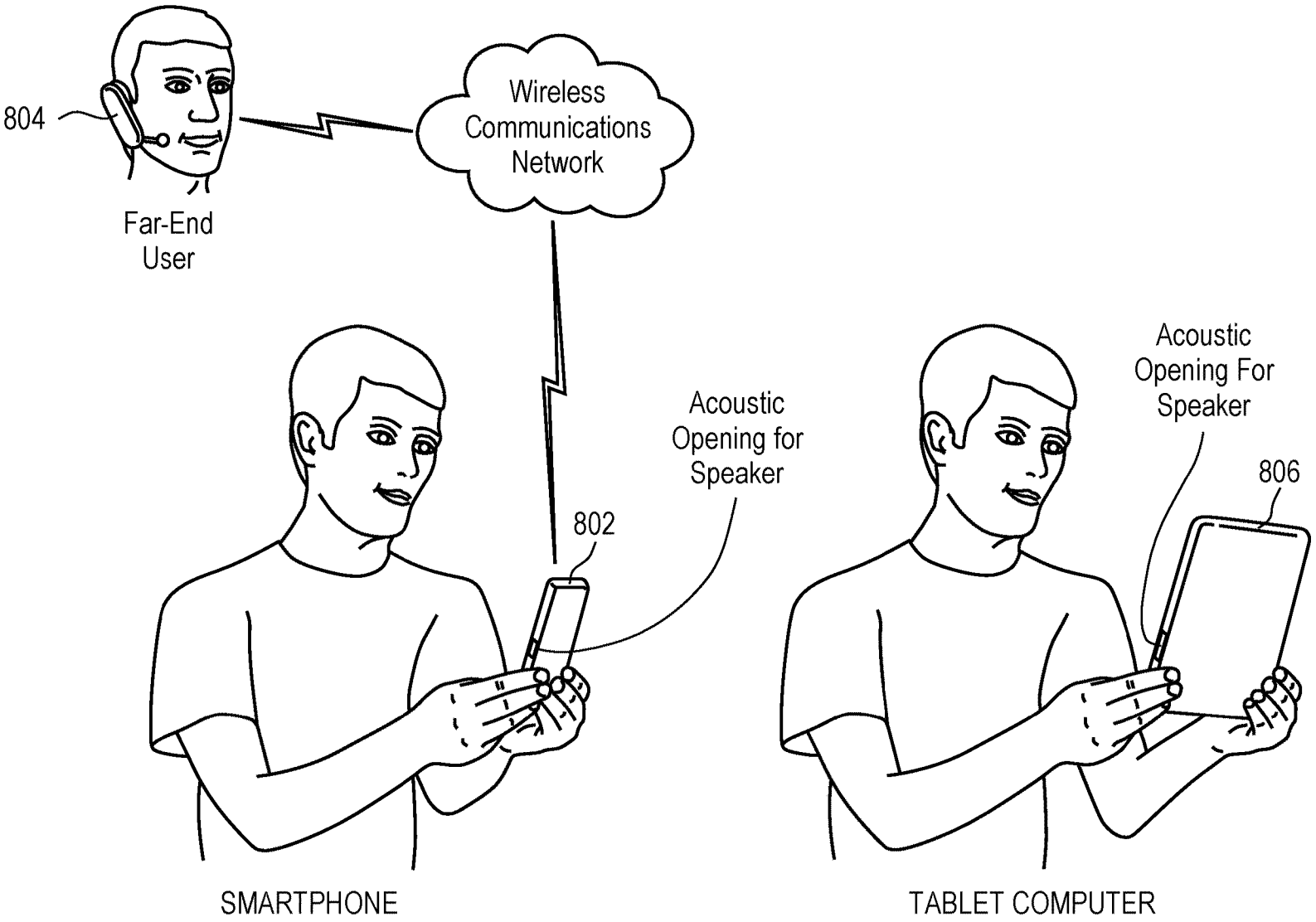
FIG. 8 illustrates one embodiment of an electronic device in which a membrane as disclosed herein may be implemented.

FIG. 8 illustrates one embodiment of a simplified schematic view of one embodiment of an electronic device in which a transducer (e.g., a micro-speaker), such as that described herein, may be implemented. As seen in FIG. 8, the transducer may be integrated within a consumer electronic device 802 such as a smart phone with which a user can conduct a call with a far-end user of a communications device 804 over a wireless communications network; in another example, the speaker may be integrated within the housing of a tablet computer 806. These are just two examples of where the speaker described herein may be used, it is contemplated, however, that the speaker may be used with any type of electronic device in which a transducer, for example, a loudspeaker or microphone, is desired, for example, a tablet computer, a desk top computing device or other display device.

Figure 9:
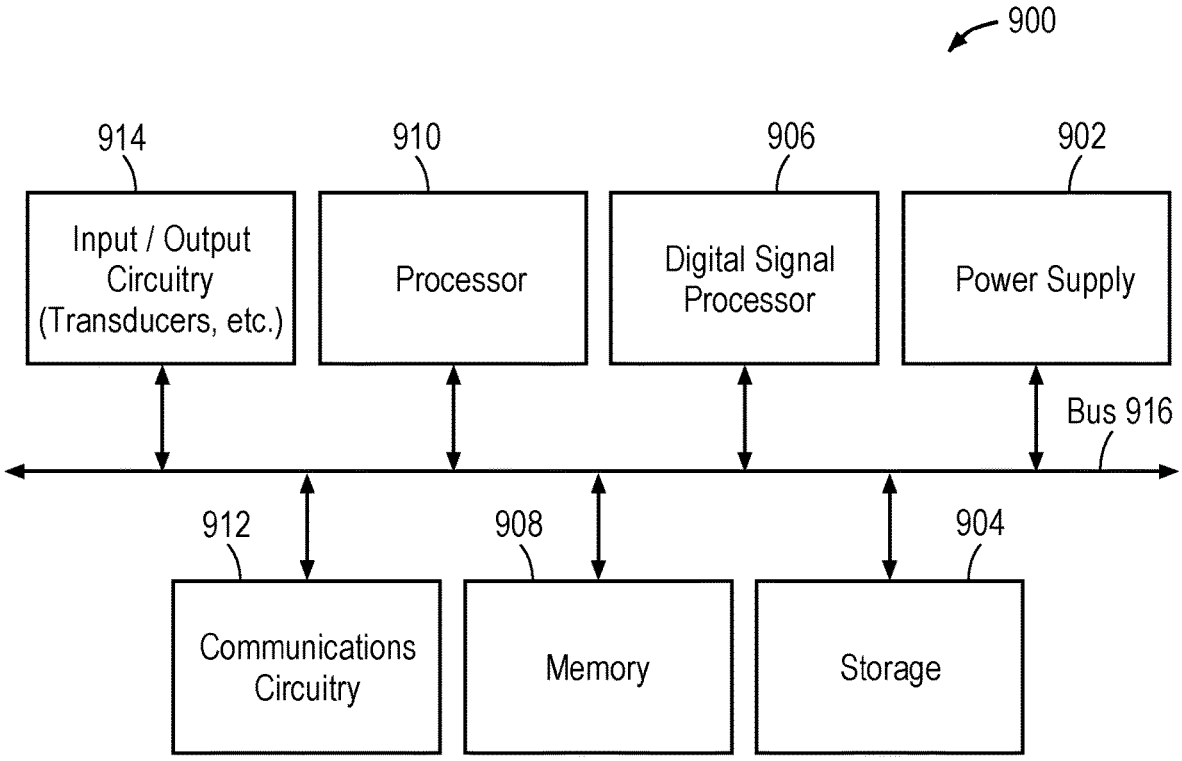
FIG. 9 illustrates a simplified schematic view of one embodiment of an electronic device in which the membrane may be implemented.

FIG. 9 illustrates a simplified schematic view of one embodiment of an electronic device in which a membrane as disclosed herein may be implemented. For example, an electronic device as discussed in reference to FIG. 8 is an example of a system that can include some or all of the circuitry illustrated by electronic device 900.

Electronic device 900 can include, for example, power supply 902, storage 904, signal processor 906, memory 908, processor 910, communications circuitry 912, and input/output circuitry 914. In some embodiments, electronic device 900 can include more than one of each component of circuitry, but for the sake of simplicity, only one of each is shown in FIG. 9. In addition, one skilled in the art would appreciate that the functionality of certain components can be combined or omitted and that additional or less components, which are not shown in FIG. 9, can be included in, for example, device 900.

Power supply 902 can provide power to the components of electronic device 900. In some embodiments, power supply 902 can be coupled to a power grid such as, for example, a wall outlet. In some embodiments, power supply 902 can include one or more batteries for providing power to earphones, headphones or other type of electronic device associated with the headphone. As another example, power supply 902 can be configured to generate power from a natural source (e.g., solar power using solar cells).

Storage 904 can include, for example, a hard-drive, flash memory, cache, ROM, and/or RAM. Additionally, storage 904 can be local to and/or remote from electronic device 900. For example, storage 904 can include an integrated storage medium, removable storage medium, storage space on a remote server, wireless storage medium, or any combination thereof. Furthermore, storage 904 can store data such as, for example, system data, user profile data, and any other relevant data.

Signal processor 906 can be, for example a digital signal processor, used for real-time processing of digital signals that are converted from analog signals by, for example, input/output circuitry 914. After processing of the digital signals has been completed, the digital signals could then be converted back into analog signals.

Memory 908 can include any form of temporary memory such as RAM, buffers, and/or cache. Memory 908 can also be used for storing data used to operate electronic device applications (e.g., operation system instructions).

In addition to signal processor 906, electronic device 900 can additionally contain general processor 910. Processor 910 can be capable of interpreting system instructions and processing data. For example, processor 910 can be capable of executing instructions or programs such as system applications, firmware applications, and/or any other application. Additionally, processor 910 has the capability to execute instructions in order to communicate with any or all of the components of electronic device 900.

Communications circuitry 912 may be any suitable communications circuitry operative to initiate a communications request, connect to a communications network, and/or to transmit communications data to one or more servers or devices within the communications network. For example, communications circuitry 912 may support one or more of Wi-Fi (e.g., a 802.11 protocol), Bluetooth®, high frequency systems, infrared, GSM, GSM plus EDGE, CDMA, or any other communication protocol and/or any combination thereof.

Input/output circuitry 914 can convert (and encode/decode, if necessary) analog signals and other signals (e.g., physical contact inputs, physical movements, analog audio signals, etc.) into digital data. Input/output circuitry 914 can also convert digital data into any other type of signal. The digital data can be provided to and received from processor 910, storage 904, memory 908, signal processor 906, or any other component of electronic device 900. Input/output circuitry 914 can be used to interface with any suitable input or output devices, such as, for example, a microphone. Furthermore, electronic device 900 can include specialized input circuitry associated with input devices such as, for example, one or more proximity sensors, accelerometers, etc. Electronic device 900 can also include specialized output circuitry associated with output devices such as, for example, one or more speakers, earphones, etc.

Lastly, bus 916 can provide a data transfer path for transferring data to, from, or between processor 910, storage 904, memory 908, communications circuitry 912, and any other component included in electronic device 900. Although bus 916 is illustrated as a single component in FIG. 9, one skilled in the art would appreciate that electronic device 900 may include one or more bus components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A transducer assembly comprising:

a frame;

a diaphragm positioned within the frame;

a surround connecting the diaphragm to the frame, the surround having a corner section and a series of alternating ribs and furrows within the corner section, wherein the series of alternating ribs and furrows have a same continuous shape, and wherein each of the ribs or furrows comprises a length dimension perpendicular to a line of maximum stress intersecting a radial axis of the corner section;

a voice coil extending from one side of the diaphragm; and a magnet assembly having a magnetic gap aligned with the voice coil.

2. The transducer assembly of claim 1 wherein the transducer is a micro-speaker, and the line of maximum stress is parallel to a line tangential to an interior arcuate edge of the corner section.

3. The transducer assembly of claim 1 wherein the line of maximum stress is perpendicular to the radial axis.

4. The transducer assembly of claim 1 wherein the line of maximum stress is a region across the corner section determined to be subject to a maximum level of deformation stress based on a finite element analysis of the corner.

5. The transducer assembly of claim 1 wherein the length dimension of each of the ribs or furrows is parallel to the radial axis.

6. The transducer assembly of claim 1 wherein the radial axis bisects the corner section, and the line of maximum stress intersects the radial axis at a point that is between an inner edge and an outer edge of the corner section.

7. The transducer assembly of claim 1 wherein the series of alternating ribs and furrows comprise a continuous second derivative and all other derivatives are continuous.

8. The transducer assembly of claim 1 wherein each of the ribs or furrows extends from an inner edge to an outer edge of the corner section.

9. The transducer assembly of claim 1 wherein the surround comprises a single, substantially solid membrane.

10. A surround for suspending a transducer diaphragm, the surround comprising:

a first membrane section having a length dimension parallel to a first axis;

a second membrane section having a length dimension parallel to a second axis;

a corner membrane section at an intersection between the first axis of the first membrane section and the second axis of the second membrane section, wherein the first axis and the second axis intersect to form a ninety degree angle and the corner membrane section comprises an arcuate inner edge; and a plurality of continuous corrugations within the corner membrane section, wherein the plurality of continuous corrugations comprise a series of alternating ribs and furrows having a same continuous shape, and each corrugation of the plurality of continuous corrugations comprises a length dimension perpendicular to a line tangential to the arcuate inner edge of the corner membrane section.

11. The surround of claim 10 wherein each corrugation of the plurality of continuous corrugations comprises a curved cross-sectional shape.

12. The surround of claim 10 wherein the length dimension of the plurality of continuous corrugations is perpendicular to a line of maximum stress that is parallel to the line tangential to the arcuate inner edge and intersects a center of the corner membrane section.

13. The surround of claim 10 wherein the length dimension of each corrugation of the plurality of corrugations are parallel to one another.

14. The surround of claim 10 wherein the length dimension of each corrugation of the plurality of corrugations runs from an inner edge to an outer edge of the corner membrane section.

15. A micro-speaker surround comprising:

a membrane for connecting a diaphragm to an enclosure, the membrane having a first pair of parallel side sections, a second pair of parallel side sections, and a set of corner sections connecting the first pair of parallel side sections and the second pair of parallel sides sections; and a plurality of continuous corrugations within each corner section of the set of corner sections, and wherein each of the corrugations of the plurality of continuous corrugations within each corner section have a length dimension perpendicular to a line of maximum stress intersecting a radial axis of their respective corner section and parallel to the radial axis.

16. The micro-speaker surround of claim 15 wherein the first pair of parallel sides are longer than the second pair of parallel sides.

17. The micro-speaker surround of claim 15 wherein the line of maximum stress intersects the radial axis at an angle of ninety degrees.

18. The micro-speaker surround of claim 15 wherein the plurality of corrugations within adjacent corner sections are spaced a distance apart such that they do not overlap.

* * * * *